United States Patent [19]

De Bernardini

[11] Patent Number: 4,811,955

[45] Date of Patent: Mar. 14, 1989

[54] HAND FIRE-ARM FOR SHOOTING WITHOUT AMMUNITION

[76] Inventor: Carlo De Bernardini, 8, Rue des Maraichers, 1205 Geneva, Switzerland

[21] Appl. No.: 98,874

[22] Filed: Sep. 21, 1987

[30] Foreign Application Priority Data

Sep. 29, 1986 [CH] Switzerland ..... 3887/86

[51] Int. Cl.[4] ..... A63B 67/00; F41G 3/26; F41C 19/12

[52] U.S. Cl. ..... 273/310; 434/21; 124/32

[58] Field of Search ..... 273/310, 311, 312; 434/21, 22; 42/69.01, 97, 84, 103; 89/1.814, 28.05; 124/83, 84

[56] References Cited

U.S. PATENT DOCUMENTS

| | | | |
|---|---|---|---|
| 1,875,941 | 9/1932 | Schwartz | 42/84 |
| 2,140,945 | 12/1938 | Swartz | 42/97 |
| 2,240,681 | 5/1941 | Swartz | 42/97 |
| 2,259,569 | 10/1941 | King | 42/97 |
| 2,710,754 | 6/1955 | Varney | 273/311 |
| 3,510,965 | 5/1970 | Rhea | 434/21 |
| 3,755,951 | 9/1973 | Koon | 42/69.01 |
| 3,854,231 | 12/1974 | Broyles | 42/84 |
| 3,948,522 | 4/1976 | Fixler | 273/85 G |
| 4,281,993 | 8/1981 | Shaw | 434/22 |
| 4,352,665 | 10/1982 | Kimble et al. | 434/22 |
| 4,367,516 | 1/1983 | Jacob | 273/310 |
| 4,430,822 | 2/1984 | Fromming et al. | 42/71 R |
| 4,586,715 | 5/1986 | Scolari et al. | 434/21 |

*Primary Examiner*—Richard C. Pinkham
*Assistant Examiner*—Benjamin Layno
*Attorney, Agent, or Firm*—Young & Thompson

[57] ABSTRACT

A dummy fire-arm (1) for training comprising a sighting device (2,3) and housing a laser tube (5). The fire-arm houses a high voltage portion (9) of the laser tube (5) triggering device (25, 30) as well as an optical focusing device (10, 11). This fire-arm (1) is carried by a lower portion (12) having a hand grip (13) housing the electronic control device of the laser as well as an electromechanical (25 to 31) shot departure triggering device.

3 Claims, 3 Drawing Sheets

HAND FIRE-ARM FOR SHOOTING WITHOUT AMMUNITION

The present invention has for its object a dummy hand fire-arm sending onto a photosensitive target a short focus laser beam.

For practice, a dummy fire-arm using a laser beam has already been proposed (see patent No. CH-538.667) however these devices were concerned only with guns or rifles.

With the development of amusement shooting but primarily for pistol competition as well as for the training of police agents, it is now important to have a dummy hand fire-arm enabling training under real shooting conditions but without ammunition.

The present invention has for its object the realization of a dummy hand fire-arm emitting a laser beam of short duration which distinguishes itself by the fact that it comprises a gun having a sighting device and housing a laser tube, the high voltage position of the firing device of said laser tube as well as an optical focussing device of the laser beam; this gun being carried by a lower portion having a grip housing the electronic control device of the laser as well as an electro-mechanical control device of the shot.

The attached drawings show schematically and by way of example one embodiment of the dummy hand fire-arm according to the invention.

Figure 1:
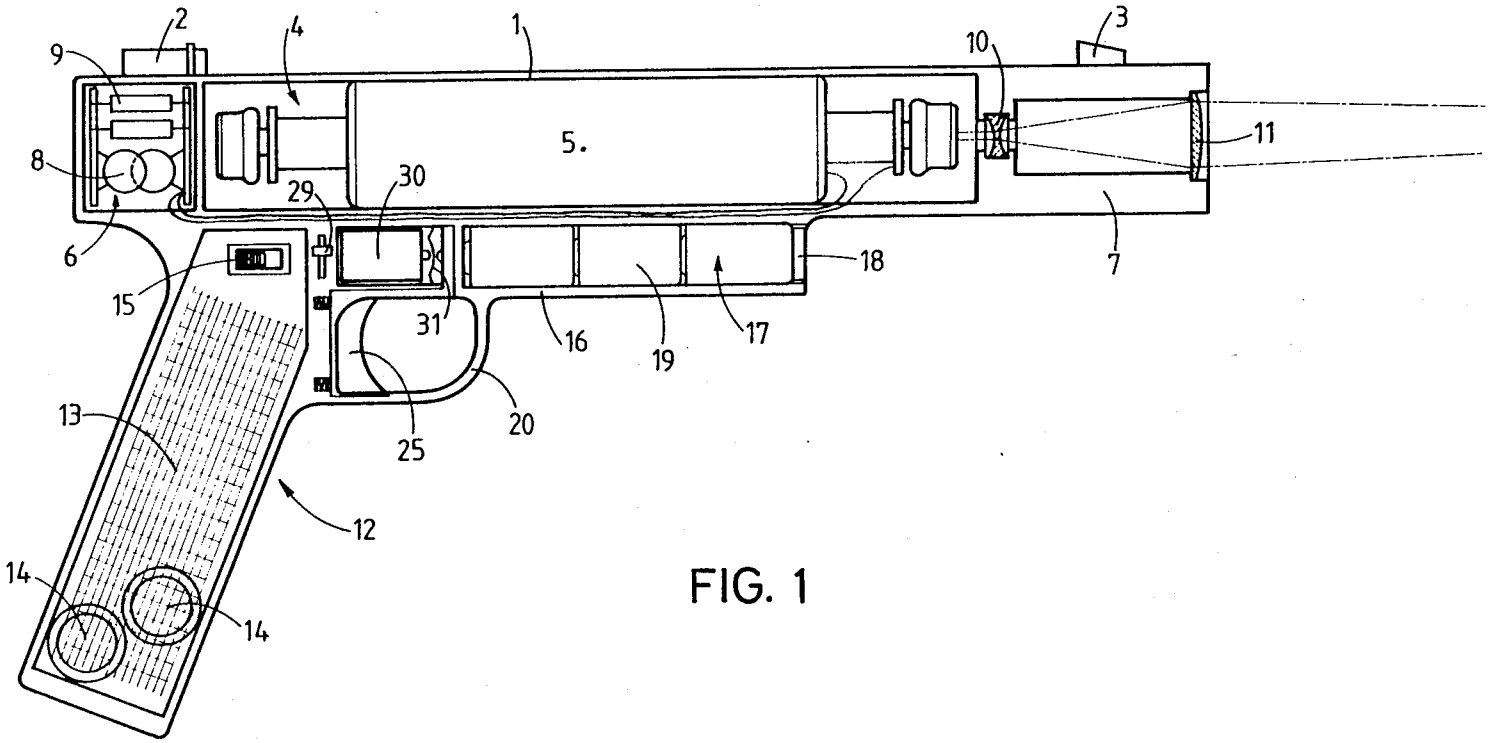
FIG. 1 is a side view of it partly in cross section.
Figure 2:
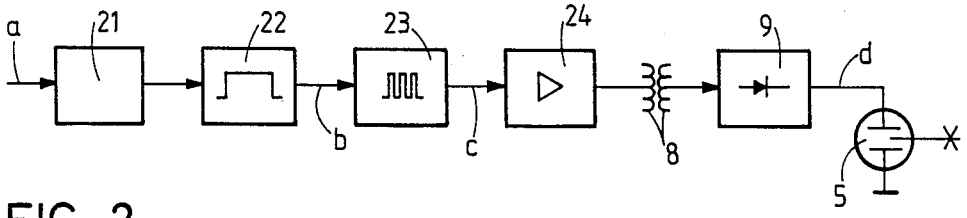
FIG. 2 shows a block diagram of the control device and of the electric triggering device of the laser.

The dummy hand fire-arm shown comprises a gun 1 or tube provided with a sighting device formed here of a rear sight 2 and a front sight 3. Generally the sight 2 is adjustable. This gun 1 houses in a central compartment 4 a laser tube 5, in a rear compartment 6 the high voltage portion of the triggering device of the laser tube and in a frontal portion 7 an optical focussing device.

The high voltage portion of the triggering device of the laser comprises a high voltage rectifier 9.

A transformer 8 feeding the rectifier 9 is housed in the hand grip 13.

The optical focussing device comprises two lenses, a biconcave lens 10 and a plano-convex lens 11, mounted on the tube 1 coaxially with the laser tube 5.

The dummy fire-arm shown comprises further a grip or lower part 12 comprising a hand grip 13 which houses the electronic circuit constituting the electronic control of the laser 5 and the accumulators or batteries 14 for the feeding with electric energy of the weapon. This grip comprises further an on/off switch 15 cutting the feeding of the electric circuit. This lower part of the dummy fire-arm comprises further a support 16, the front portion of which forming a housing 17 having a screwed cover 18. The housing 17 is intended to receive a ballast 19, and the rear part of which comprises a trigger guard 20 housing the electro-mechanical control device for releasing the shot.

By adjusting the weight of the ballast 19 and its position within the housing 17, it is possible to adjust the weight of the dummy fire-arm to the weight of a real shooting fire-arm as well as to its weight distribution or its balancing. It is in fact important for the shooter to have a dummy fire-arm the characteristics of which, particularly the dimensions, the weight and the balance are as close as possible to the corresponding real fire-arm for the training with the dummy fire-arm to be equivalent to training with a real fire-arm.

The electronic circuit 13 of the electronic control device of the laser tube 5 triggered by the electro-mechanical control device of the shot release comprises a timer 21, hindering the departure of a second shot during a predetermined time after a first shot, a generator 22 of pulses of a duration of about 30 miliseconds, an oscillator 23 of 20 kHz feeding a power stage 24 the output of which is connected to the primary of the transformer 8, the secondary of which feeds the high voltage rectifier multiplier 9 connected to the laser tube 5.

Figure 3:
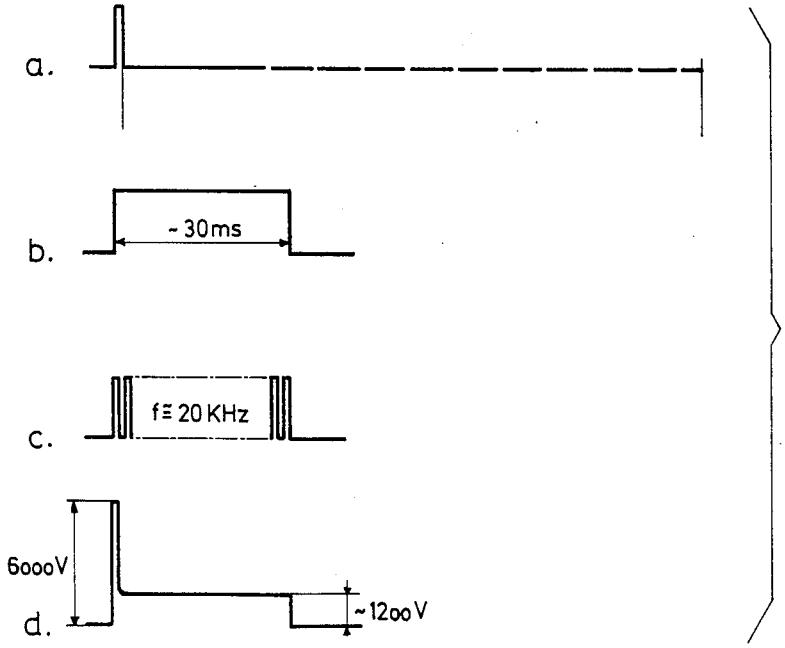
FIG. 3 shows the shape of the electric control pulses of the laser.
Figure 5:
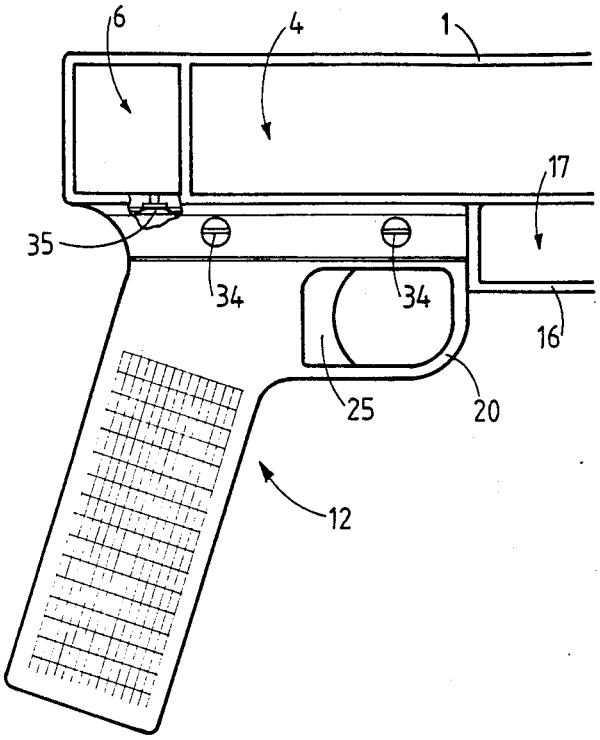
FIG. 5 is a partial side view of the dummy fire-arm.
Figure 4:
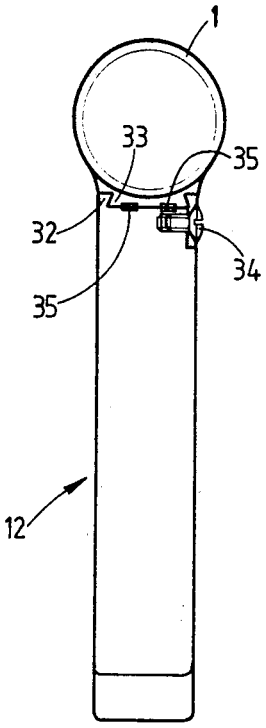
FIG. 4 is a partial view from the rear of the dummy fire-arm.
Figure 6:
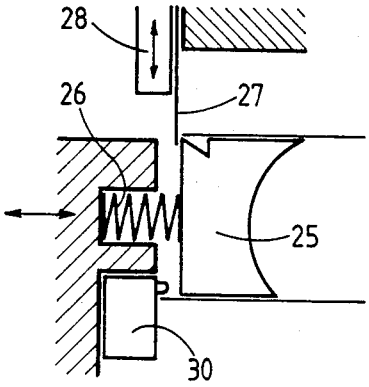
FIG. 6 shows schematically the electro-mechanical control device of the shot release.

FIG. 3 shows in diagram a the pulse obtained by the electro-mechanical shot triggering device, in diagrams b and c the shape of the pulses delivered by the generator 22 respectively the oscillator 23 and in diagram d the 6000 volts pulse delivered by the high voltage rectifier for the triggering of the laser tube 5, voltage which falls to about 1200 volts during the firing of the laser tube 5.

The electro-mechanical shot triggering control device mounted in the lower part of the dummy fire-arm comprises a sliding or pivoting trigger 25 subjected to the action of a weak spring 26 tending to place it in a forward inactive position. The abutment against which rests the weak spring 26 is adjustable to permit the adjustment of the force necessary to displace the trigger.

The pull of the trigger is here simulated by a spring blade 27 the end of which is located on the path of a catch on the trigger. The pull can be adjusted by means of a slide 28 used as an abutment for the spring blade 27 and the position of which is adjustable by means of a cursor 29 accessible from the lateral face of the grip. A screw adjustment can also be provided.

The trigger 25 cooperates at the end of its stroke with a shot departure detector 30 comprised by an electric commutator, a piezoelectric pad, a strain gauge etc. A membrane 31, having a displacement force such as computer or telephone keys, located between the trigger and the detector can also be used to augment the pull of the trigger.

For the training of shooting it is important that the shooter be subjected to real shooting conditions, this is why in this embodiment of the dummy hand fire-arm the lower portion 12 of it is removably fixed to the gun 1 by means of a sliding assembly 32, 33. Lateral screws 34 permit a rigid fixation of both parts the one onto the other. Contacts 35 ensure automatically during the setting in place of the two parts the one onto the other the electrical connections between the control device formed by the electronic circuit housed in the hand grip 13 and the high voltage portion 9 of the laser tube triggering or firing device.

In this way the user can fix on the gun 1 of the dummy fire-arm a lower portion 12 the grip of which corresponds in shape as well as in weight to that of the pistol he uses for bullet shooting.

Therefore, several lower parts 12 corresponding to different types or models of hand weapons can be provided.

It will however be evident that in an embodiment of the dummy fire-arm intended for amusement shooting, the tube 1 and the grip 12 could be solid, for example made of two injected half shells. In fact for such a use it is not necessary that the dummy hand weapon be identical in weight, shape and balance to a given real weapon.

I claim:

1. A dummy hand fire-arm emitting a laser beam of short duration, comprising a pistol having a sighting device and housing a laser tube, the laser tube having a firing device having a high voltage portion and an optical focusing device for the laser beam, the pistol having a hand grip housing an electronic control means of the laser as well as an electro-mechanical triggering device for the beam, said triggering device comprising a trigger pulled by a finger of the user of the fire-arm, and means yieldably to resist pulling the trigger, said resisting means comprising a membrane which is displaceable and which acts against movement of the trigger to augment the pull of the trigger.

2. A dummy hand fire-arm emitting a laser beam of short duration, comprising a pistol having a sighting device and housing a laser tube, the laser tube having a firing device having a high voltage portion and an optical focusing device for the laser beam, the pistol having a hand grip housing an electronic control means of the laser as well as an electro-mechanical triggering device for the beam, said triggering device comprising a trigger pulled by a finger of the user of the fire-arm, and means yieldably to resist pulling the trigger, said resisting means comprising a spring blade against which a portion of the trigger bears when pulled by the user of the fire-arm, said spring blade yieldably resisting rearward movement of the trigger.

3. A dummy fire-arm as claimed in claim 2, and means selectively to adjust the length of the spring blade which is subject to deformation upon rearward movement of the trigger thereby to modify the resistance of the spring blade to said rearward movement of the trigger.

* * * * *